US005369898A

United States Patent [19]

Sorensen

[11] Patent Number: 5,369,898

[45] Date of Patent: Dec. 6, 1994

[54] SURFACE MOUNT FRAME WITH NESTING IRONING BOARD

[76] Inventor: Jake A. Sorensen, 1746 N. Heather Dr., Orem, Utah 84057

[21] Appl. No.: 18,018

[22] Filed: Feb. 16, 1993

[51] Int. Cl.[5] ..... D06F 81/06; A47B 5/04

[52] U.S. Cl. ..... 38/137; 108/48

[58] Field of Search ..... 38/103, 104, 137, 139, 38/40, DIG. 2, DIG. 3; 108/13, 42, 48; 312/242, 245

[56] References Cited

U.S. PATENT DOCUMENTS

| | | | |
|---|---|---|---|
| 960,213 | 5/1910 | Williams | 108/40 |
| 1,202,959 | 10/1916 | Biggs | 108/40 |
| 1,207,747 | 12/1916 | Grimshaw | 108/40 |
| 1,541,342 | 6/1925 | Friel | 108/12 |
| 1,568,228 | 1/1926 | Lippert | 108/40 |
| 1,679,581 | 8/1928 | McCray | 38/137 |
| 1,699,496 | 1/1929 | Wasmuth | 108/40 |
| 1,849,184 | 3/1932 | Gay | 108/48 |
| 2,106,044 | 1/1938 | Young et al. | 38/137 |
| 2,358,906 | 9/1944 | Bullard | 108/40 |
| 2,527,682 | 10/1950 | Lyon et al. | 38/137 |
| 2,549,723 | 4/1951 | Thatcher | 108/40 X |
| 2,707,840 | 5/1955 | Doyle | 108/13 |
| 3,696,762 | 10/1972 | Holdham | 108/48 X |
| 4,047,488 | 9/1977 | Gutridge et al. | 108/48 X |
| 4,507,963 | 4/1985 | Donner et al. | 16/224 X |
| 4,862,611 | 9/1989 | Wright | 38/140 X |
| 4,862,811 | 9/1989 | Davis | 108/48 X |
| 4,995,681 | 2/1991 | Parnell | 38/139 X |
| 4,998,484 | 3/1991 | Groetzinger | 108/42 |

FOREIGN PATENT DOCUMENTS

| | | | |
|---|---|---|---|
| 0309142 | 3/1989 | European Pat. Off. | 38/104 |
| 0025628 | 8/1952 | Finland | 38/40 |
| 2436211 | 5/1980 | France | 38/139 |
| 372948 | 5/1931 | United Kingdom | 108/40 |

OTHER PUBLICATIONS

All R Prodx, Inc., "Windsor Ironing Center" (U.S. Pat. No. 4,909,158).

NeatWay Inc., "The Convenient and Space-saving Ironing Center".

*Primary Examiner*—Clifford D. Crowder

*Assistant Examiner*—Ismael Izaguirre

*Attorney, Agent, or Firm*—Thorpe, North & Western

[57] ABSTRACT

An ironing board structure which may be readily mounted on, or integrated into, a variety of vertical surfaces. The entire ironing board structure is preferably not more than one inch thick. An ironing board is cut from a planar sheet of material. The ironing board is pivotally held in the opening left in the planar sheet of material. Advantageously, the ironing board is cut from a single unitary planar sheet of material which will also form a frame for the ironing board. When in its storage position, the ironing board is substantially coplanar with the remaining planar material which forms a frame and takes up very little space. When in its service position, the ironing board is oriented perpendicularly to the frame and the ironing board protrudes out from the frame so that it is usable for its intended function. The structure of the ironing board and the frame allows the structure to be very efficiently and economically fabricated and installed and exhibit strength and rigidity.

19 Claims, 4 Drawing Sheets

SURFACE MOUNT FRAME WITH NESTING IRONING BOARD

BACKGROUND

1. The Field of the Invention

This invention relates to ironing boards which are mounted on a wall and move between a storage position and a service position.

2. The Background Art

An ironing board is an item which many households deem indispensable. While many households utilize ironing boards which are free standing, it is generally accepted that an ironing board which is permanently mounted on a wall and which can be moved between a storage position and a service position is most convenient and desirable.

There have been numerous devices introduced into the art which store an ironing board in a cabinet mounted on a wall. Some of the previously available devices even store the ironing board within the cavity of the wall. Such previously available devices and arrangements are relatively expensive to manufacture and difficult to install. Thus, many who desire to obtain an ironing board which is permanently mounted on a wall do not do so because of the associated expense and difficulty with installation. For example, problems with installation include wall studs being improperly positioned, electrical wiring and plumbing being in the way, and household furnishings blocking an area.

Moreover, free standing ironing boards are often cumbersome to set up and both free standing ironing boards and previously available wall mounted ironing boards take up valuable space in living areas which are often cramped and crowed.

In view of the drawbacks encountered in the present state of the art, it would be an advance in the art to provide an ironing board which can be readily mounted on a variety of vertical surfaces and which can be fabricated very efficiently and economically. It would also be an advance in the art to provide a surface mount ironing board having a thin profile and which protrudes above the underlying surface only a small amount and which does not require any significant intrusion into, or modifications to, the underlying mounting surface.

BRIEF SUMMARY AND OBJECTS OF THE INVENTION

In view of the above described state of the art, the present invention seeks to realize the following objects and advantages.

It is an object of the present invention to provide an ironing board which can be readily mounted on a variety of vertical surfaces.

It is another object of the present invention to provide an ironing board which can be mounted on, or incorporated into, many different vertical surfaces and fabricated very efficiently and economically.

It is a further object of the present invention to provide a surface mount ironing board having a slim line profile and which protrudes above the underlying surface only a small amount when mounted thereon.

It is yet another object of the present invention to provide an ironing board which can be mounted on any number of different vertical surfaces without requiring significant intrusion into, or modifications to, the underlying mounting surface.

It is a further object of the present invention to provide a surface mount ironing board which can be fabricated from inexpensive materials.

It is a still further object of the present invention to provide a surface mount ironing board which requires few parts, little assembly, and is rugged and sturdy.

It is another object of the present invention to provide a surface mount ironing board whose appearance is suitable for installation in any living area in a home and which occupies very little space.

It is a further object of the present invention to provide a surface mount ironing board wherein the cabinet and the ironing board are fabricated from a single piece of rigid material.

It is yet another object of the present invention to provide a surface mount ironing board which can be efficiently packaged and shipped.

These and other objects and advantages of the invention will become more fully apparent from the description and claims which follow, or may be learned by the practice of the invention.

The present invention provides an ironing board structure which may be readily mounted on, or integrated into, a variety of surfaces. The ironing board structure includes a frame which acts as a cabinet for the ironing board. The frame is preferably a generally planar sheet of material not more than a few inches thick and preferably not more than one inch thick.

The ironing board is attached to the frame such that it is pivotally held in an opening provided in the frame. A means for pivotally holding the ironing board allows the ironing board to move between a storage position and a service position. In its preferred form, the apparatus of the present invention does not require complicated attachments such as the hardware necessary in the previously available surface mount ironing boards.

The simplified structure of the apparatus of the present invention and the method of manufacturing in accordance with the present invention allows the apparatus to be efficiently and economically fabricated as well as being sturdy, rigid, and rugged. Moreover, the apparatus is takes up little living space when mounted on a wall.

When in its storage position, the ironing board is substantially coplanar with the frame. Thus, the apparatus protrudes above the underlying mounting surface only a small amount when the ironing board is being stored. When the ironing board is in its service position, the ironing board is oriented at an angle to the frame and the ironing board protrudes out from the frame so that it is usable for its intended function.

A means for limiting the pivoting movement of the ironing board is included so that the ironing board is held substantially perpendicular to the frame when it pivots to its service position. The means for limiting the pivoting movement preferably includes a first slot formed in the ironing board, a second slot formed in the frame, the first slot and the second slot being arranged colinearly and accurately aligned, and a stop having a first end which is held captive within the first slot and a second end which is held captive within the second slot. The length of the first slot and the second slot, as well as the length of the stop, are selected so that the pivoting movement of the ironing board is limited to a range of about ninety degrees and preferably not more than about 110 degrees.

A preferred method of fabrication in accordance with the present invention allows the apparatus to be made most efficiently. First, a sheet of substantially planar material is selected which has a length and a width at least slightly greater than the length and the width of the ironing board.

Next, two bores and a slot are formed in the planar material. The bores are formed through two opposing edges of the planar material such that the bores extend into the area of the planar material from which the ironing board will be formed. Along with the bores, a channeled slot is formed on one surface of the planar material. The channeled slot is oriented substantially perpendicularly two bores. The placement of the slot is such that it partially resides in the area of the planar material from which the ironing board will be formed and partially in the area of the planar material which will function as the fame.

By forming the bores and the channeled slot before cutting the planar material to separate the ironing board, the proper alignment of the bores and the channeled slot is assured and proper operation of the apparatus will occur. Moreover, by (1) forming both the frame and the ironing board from the same piece of material, (2) making the frame and the ironing board unitary pieces of material, and (3) using the described preferred method of fabrication, the apparatus of the present invention consistently functions well and is aesthetically pleasing.

After the bores and the channeled slot are formed, a cut is made along the perimeter shape of the ironing board which allows the ironing board to be removed from the planar member. Once the ironing board is removed, an opening of the same shape and slightly larger size is left in the planar material.

The proximal end of the ironing board is pivotally attached near the bottom end of the opening such that the ironing board can pivot between a storage position where the ironing board is substantially coplanar with the planar material and a service position where the ironing board is substantially perpendicular to the planar member. Structures are then formed for supporting the ironing board in the service position and assembly of the apparatus is completed. The simple and rugged construction of the inventive apparatus provides significant advantages over other available structures.

BRIEF DESCRIPTION OF THE DRAWINGS

In order to better appreciate how the above-recited and other advantages and objects of the invention are obtained, a more particular description of the invention briefly described above will be rendered by reference to a specific embodiment thereof which is illustrated in the appended drawings, Understanding that these drawings depict only a typical embodiment of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Reference will now be made to the drawings wherein like structures will be provided with like reference designations.

Figure 1:
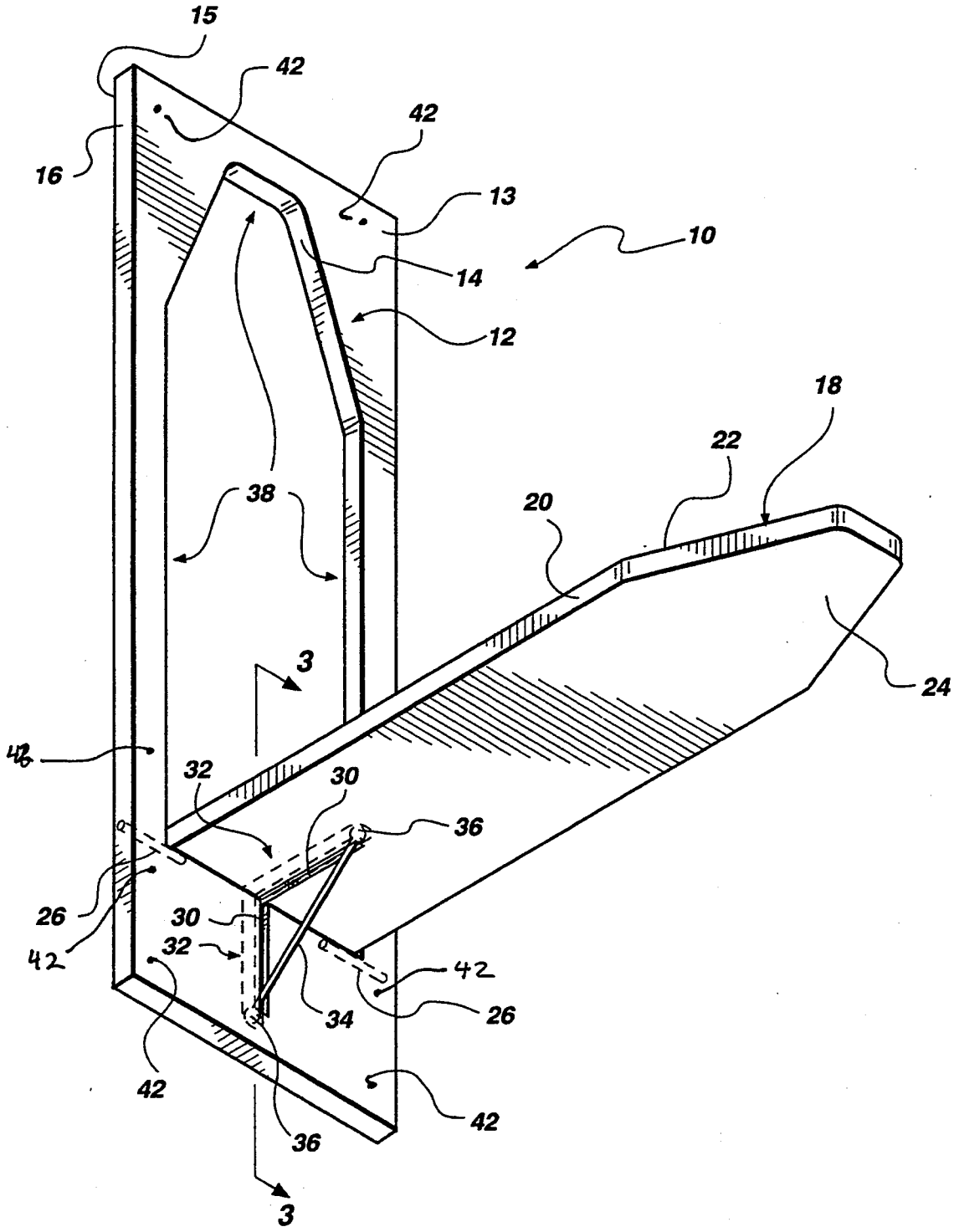
FIG. 1 is a perspective view of a first presently preferred embodiment of the surface mount ironing board in accordance with the present invention.

FIG. 1 provides a perspective view of the preferred arrangement of the present invention. The surface mount ironing board illustrated in FIG. 1 is generally designated at 10. The apparatus illustrated in FIG. 1 provides significant advantages over the previously available ironing boards which are mounted on a wall. The illustrated apparatus can be manufactured much less expensively, and installed much more easily, than other available structures performing similar functions. Thus, the cost and ease of installation of the apparatus of the present invention makes it a desirable alternative to free standing ironing boards.

The apparatus of the present invention also provides the advantage of being mountable on any number of surfaces. For example, the apparatus can be mounted on a wall, on a door, or can be integrally formed as part of almost any substantially vertical surface. Particular advantages of the present invention are that the apparatus protrudes only a very limited distance from the wall, preferably not more than two inches and most preferably only about an inch, and no substantial modifications are required to the wall. Moreover, it will be appreciated that the apparatus described herein can also readily be used as a table, with or without modifications such as a change to the preferred dimensions.

FIG. 1 illustrates the apparatus 10 in a service position which is the position taken when the ironing board is to be used. The ironing board is generally designated at 18. The ironing board 18 includes a work surface 22, an exterior perimeter 20, and a bottom surface 24. The ironing board 18, which can also be referred to as a work surface member since it can be used to support objects other than ironing items, can be fabricated in many different shapes and sizes within the scope of the present invention. Moreover, it will be understood that embodiments of the present invention can be made different sizes to accommodate the contemplated end use of the apparatus.

The ironing board 18 is attached to a cabinet generally designated at 12. It will be appreciated that the illustrated cabinet 12 does not completely enclose the ironing board 18 but in the illustrated embodiment appears more like a frame. The cabinet 12 performs many of the functions carried out by cabinets included in the previously available devices. Thus, structures serving the function of the cabinet 12 may properly be referred to as a cabinet, a frame, or some equivalent designation. Moreover, it is within the scope of the present invention to include one or more doors (not represented in the figures) connected to the cabinet 12. Such doors can be used to completely conceal an ironing board 18 if desired.

Still referring to FIG. 1, the cabinet 12 includes a front surface 13 and a back surface 15 which are preferably both generally planar and parallel to each other. The cabinet 12 also includes an outer perimeter 16, an opening 38, and an inner perimeter 14. The cabinet 12 is mounted onto a vertical surface using any number of available methods known in the art. For example, eight mounting holes 42 are provided and function, along with accompanying fasteners (not represented in the figures), function as a means for mounting the frame on a substantially vertical surface. Alternatively, the apparatus 10 can be integrally formed as part of the vertical surface. For example, the vertical surface can be part of a wall, a door, a partition, and so forth.

The cabinet 12 can be made from many materials known in the art. It is preferred that the cabinet be fabricated from a wood material, most preferably a hard wood. Also, as will be explained shortly, it is preferred that the cabinet 12 and the ironing board 18 be fabricated from the same material and preferably from the same piece of such material.

Exemplary dimensions for the cabinet 12 are 17¼ inches wide and 57 inches long and 1 inch thick. It will be appreciated that the slim line appearance and the thinness of apparatus 10 is one of its important features. Those skilled in the art will appreciate that if the size of the apparatus is reduced, a thinner material can be used while still retaining the desirable characteristics of rigidity and strength. It will be understood that by using appropriate materials, the thickness of the cabinet 12 and the ironing board 18 can preferably range from fractions of an inch to two inches. Most preferably, however, the cabinet 12 will be about 1 inch thick. Moreover, in accordance with the method of fabrication of the present invention, it will be appreciated that the cabinet 12 and the ironing board 18 preferably are both unitary structures which are preferably fabricated from a single piece of planar material. It will also be readily understood that the shape of the cabinet 18 can be any desirable shape considering strength, rigidity, aesthetics, and mounting requirements, with the illustrated rectangular shape being generally preferred.

The ironing board 18 is pivotally attached at its proximal end to the cabinet 12 adjacent to the lower end of the opening 38. Pivots 26 are inserted into bores made through the outer perimeter 16 of the cabinet 12 and into the exterior perimeter 20 of the ironing board 18. The pivots 26 are preferably cylindrical metallic segments, for example, four inches long and having a diameter of 5/16 inch. It will be appreciated that the proximal end of the ironing board 18 can be finished so that there is no undesirable contact between the ironing board and the inner perimeter 14 of the frame 12 as the ironing board 18 pivots within the frame 12.

Importantly, using the method of fabrication described herein, the bores into which the pivots 26 are inserted are accurately aligned. In particular, the formation of the bores for the stops 26 before the ironing board is cut from the frame 12 ensures accurate alignment. Accurate alignment is necessary for proper operation and appearance of the apparatus. Moreover, it is within the scope of the present invention to utilize a continuous bore and a single pivot which extends from one side of the frame 18, through the ironing board 18, and to the other side of the frame 18. Such a continuous bore and single pivot will provide additional strength and rigidity to the apparatus.

A stop 34 which is positioned within a channeled slot, generally designated at 32, is provided to limit the pivoting movement of the ironing board 18 to between what are referred to herein as a storage position and a service position. In the case of the illustrated embodiment, the service position is preferably substantially perpendicular to the cabinet 12.

The stop 34 is preferably a cylindrical metallic segment ten inches long having a diameter of 5/16 inch. Each end of the stop 34 is provided with a ball 36, each ball preferably having a diameter of ½ inch. The entire stop structure can be fabricated from a single piece of material.

Figure 2:
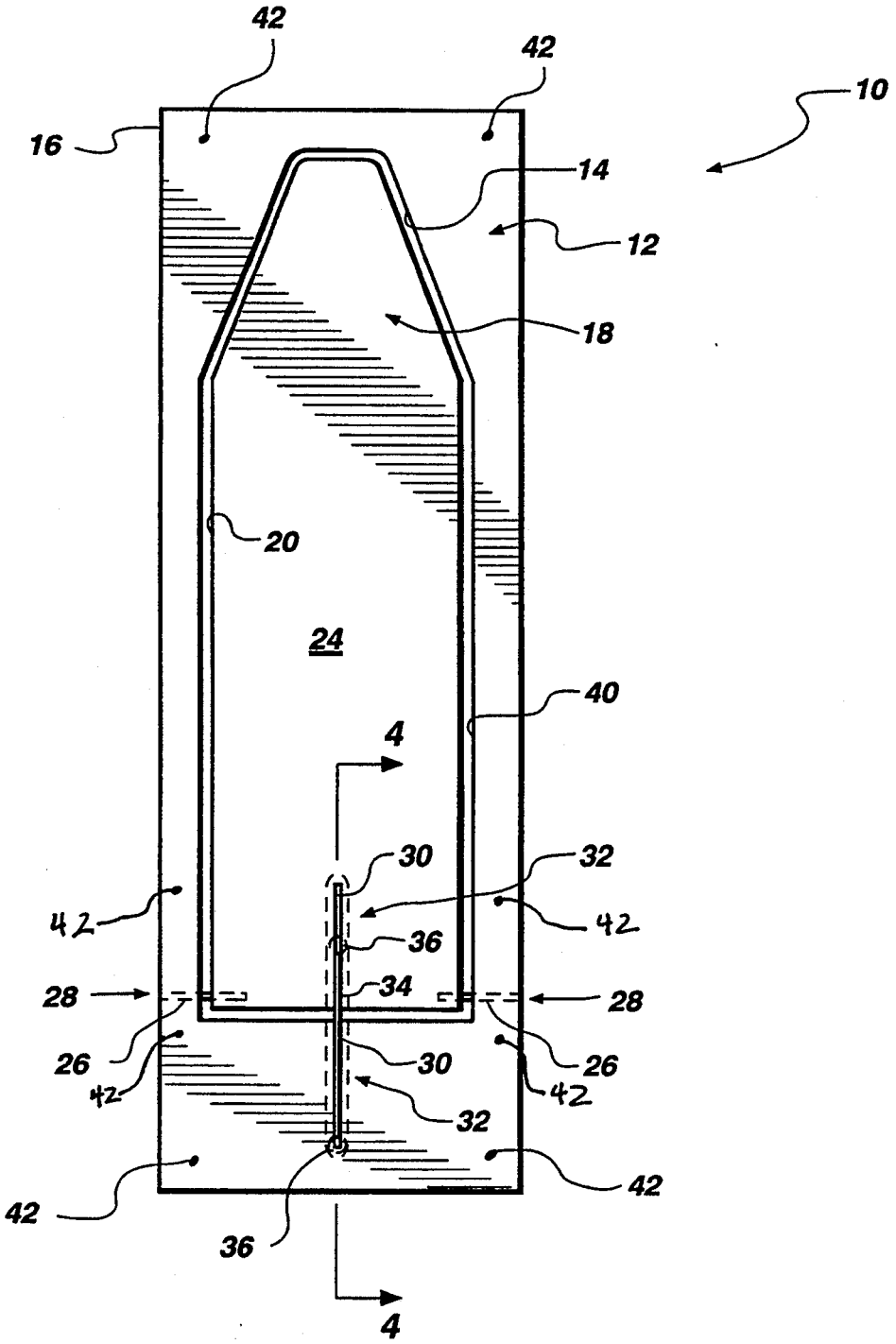
FIG. 2 is a elevational view of the surface mount ironing board represented in FIG. 1.

FIG. 2 provides an elevational view of the apparatus 10 showing the ironing board 18 in its storage position. When the ironing beard 18 is in its storage position the entire apparatus generally is contained within the thickness of the cabinet 12. Desirably, when in its storage position, there are substantially no protrusions from the apparatus.

In some instances the work surface 22 of the ironing board 18 may be provided with a pad (not illustrated) which will add some bulk to the ironing board 18. If the apparatus 10 is to be mounted on a wall or similar vertical surface, the cabinet 12 can be mounted slightly separated from the wall to accommodate the bulk of any ironing board pad. For example, resilient spacers (not illustrated in the figures) can be placed between the frame 12 and the mounting surface.

FIG. 2 illustrates the preferred arrangement where the shape of the exterior perimeter 20 of the ironing board 18 substantially matches the shape of the interior perimeter 14 of the cabinet 12. FIG. 2 also shows the linear positioning of the channeled slot 32 on both the bottom surface of the ironing board 18 and on front surface 13 of the cabinet 12. Importantly, using the method of fabrication desired herein, the channeled slot 32 is accurately aligned. Accurate alignment is necessary for proper operation and appearance of the apparatus.

Figure 3:
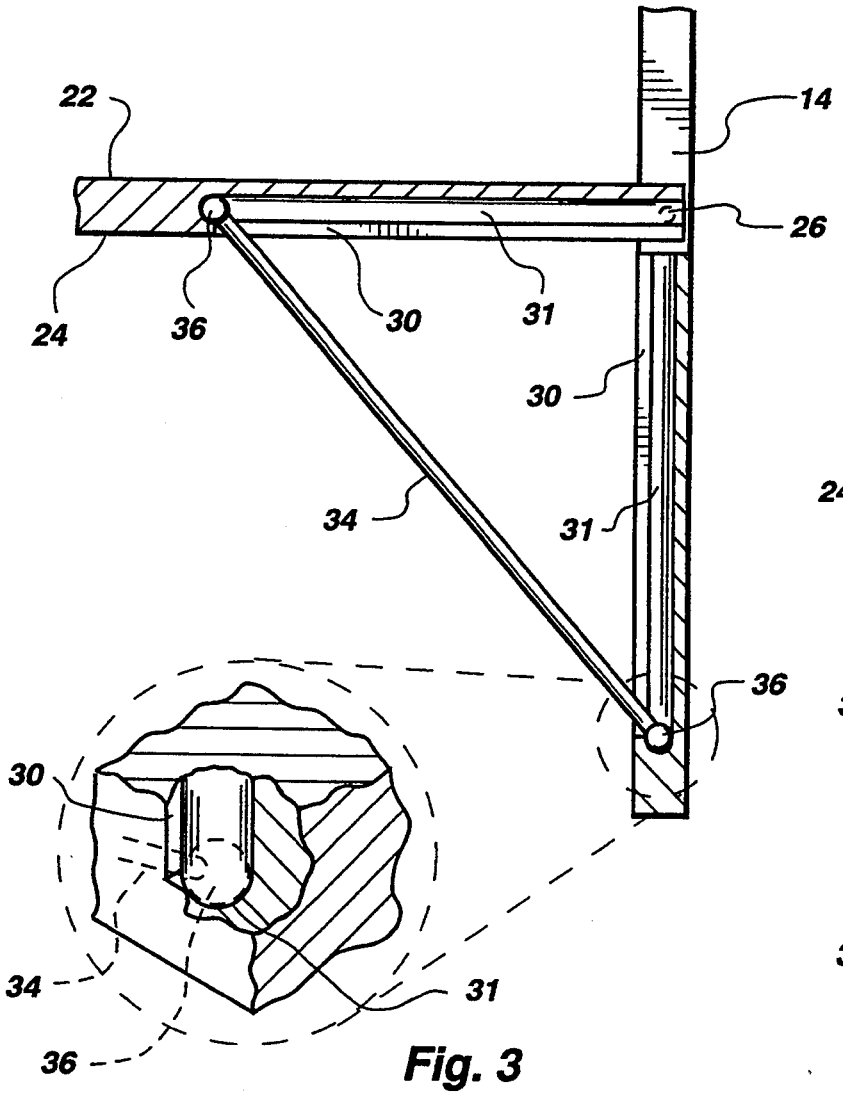
FIG. 3 is a partial cross sectional view taken along line 3—3 of FIG. 1 illustrating the ironing board in its service position.
Figure 4:
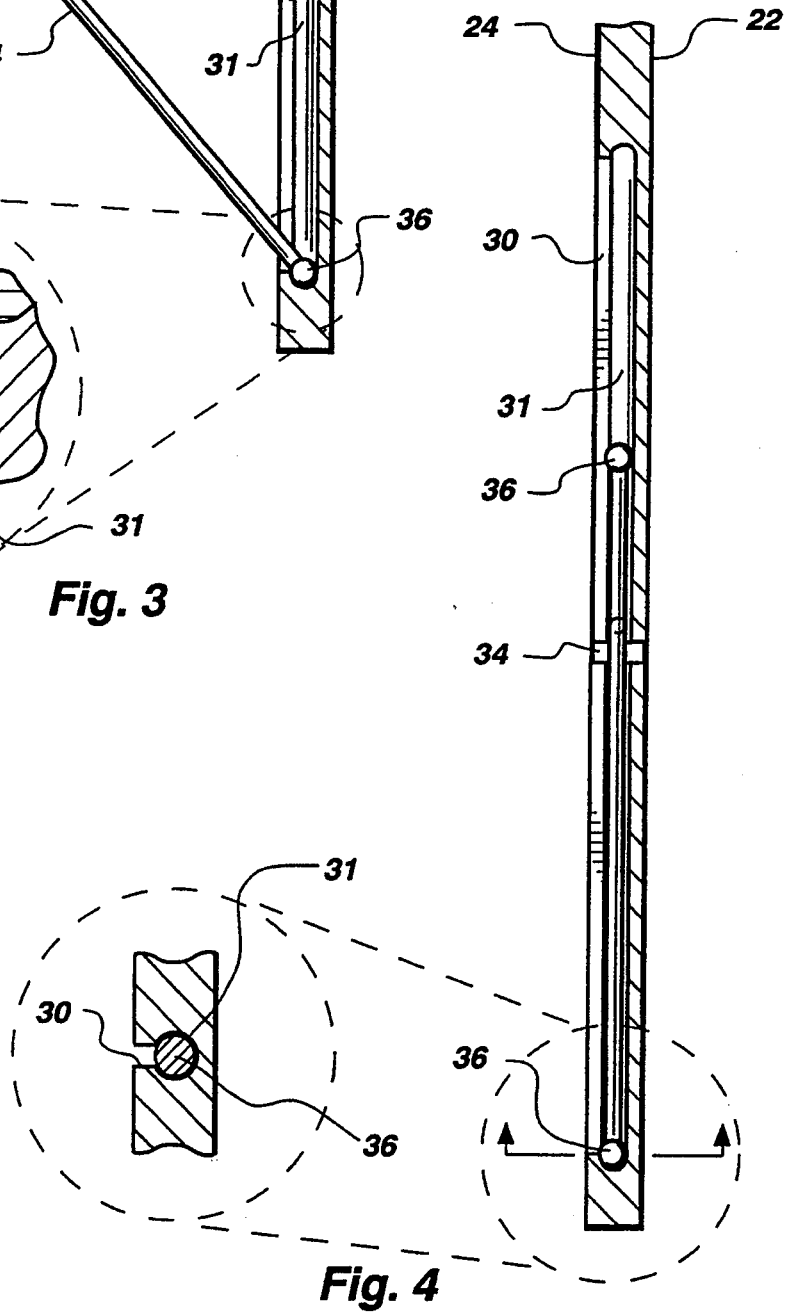
FIG. 4 is a partial cross sectional view taken along line 4—4 of FIG. 2 illustrating the ironing board in its storage position.

FIGS. 3 and 4 each provide a cross sectional view of the ironing board 18, the cabinet 12, and the stop 34 as well as its associated structures. FIG. 3 illustrates the ironing board 18 in its service position (as also represented in FIG. 1) and FIG. 4 illustrates the ironing board 18 in its storage position (as also represented in FIG. 2).

As can be seen in FIGS. 3 and 4, the channeled slot (generally designated 32 in FIGS. 1 and 2) includes a slot 31 which is a generally cylindrical shape so that the balls 36 are in close contact with the wall of the slot 31. The cylindrical portion of the stop 34 passes through a channel 30 which connects the slot 31 with exterior surface of the structure.

As seen best in FIG. 3, the lengths of the stop 34 and the slot 31 are preferably selected so that the pivoting movement of the ironing board 18 is limited to between the two positions illustrated in FIGS. 3 and 4. It will be appreciated that the illustrated arrangement and service position are merely exemplary and that those skilled in the art will be able to devise other equivalent structures which function as a means for limiting the pivoting movement of the ironing board.

The magnified portion of FIG. 3 shows the hemispherical contact between the ball 36 and the end of the slot 31. It will be appreciated that the illustrated hemispherical contact provides the best load bearing surface and avoids the problems which would be encountered if weaker point contact and line contact load bearing structures were used. The illustrated structures all contribute to the ironing board's rigidity and strength.

FIG. 4 shows the preferred relationship between the stop 34 and the slot 31 in which the stop 34 is held captive within the slot 32 as the ironing board 18 is pivoted between the positions shown in FIG. 3 and FIG. 4, respectively. Using the structures illustrated in FIG. 4, it is preferred that the slot 31 have a diameter of about ½ inch and a length of about 14½ inches. It is also preferred that the channel 30 have a width of about ⅜ inch. The illustrated stop 24 and slot 31 structure provides a reliable and economical arrangement for keeping the ironing board in its service position. Moreover, the magnified portion of FIG. 4 shows the close tolerances used when forming the slot 31 and the ball 36.

Figure 5:
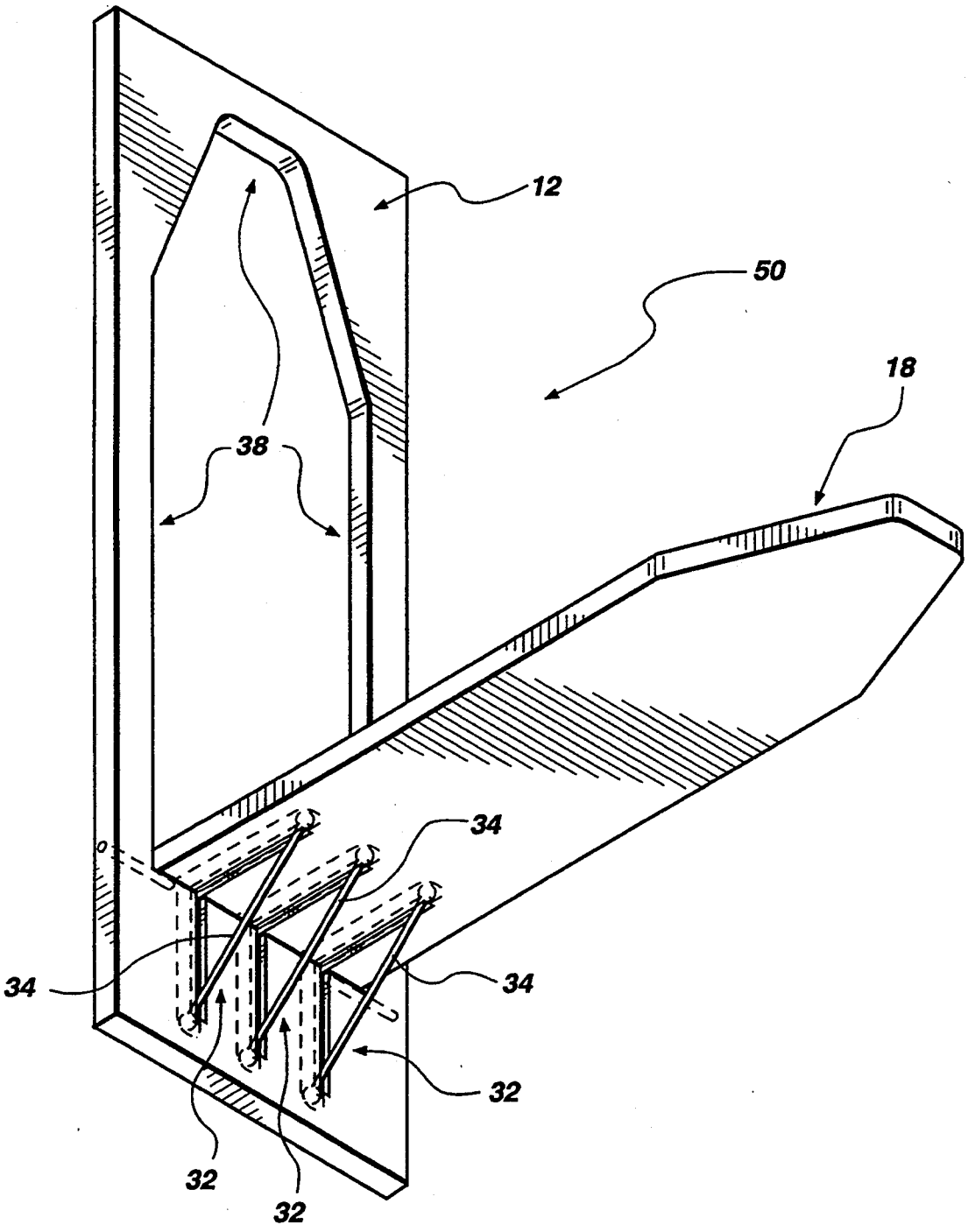
FIG. 5 is a perspective view of a second presently preferred embodiment of the surface mount ironing board in accordance with the present invention.

In some applications, it may be desirable to provide an even stronger and more rugged structure. FIG. 5 illustrates a second embodiment 50 which is generally similar to the embodiment illustrated in FIGS. 1–4 but in which three channeled slot structures 32 and three corresponding stops 24 are provided in a parallel arrangement. The embodiment illustrated in FIG. 5 exhibits additional strength. Moreover, it may be desirable to include structures to ensure that the ironing board 18 does not drop too quickly from its storage position into its service position with the resulting potential for injury to a user. By proper fabrication of the channeled slot structures 32 and the stop structures 24, the pivoting movement of the ironing board can be dampened.

It will be appreciated that the relatively simple structure of illustrated apparatus allows the present invention to be carried more economically than previously available devices. A preferred method of fabricating the embodiments of the present invention, as will now be explained, allows the present invention to be most efficiently and economically carried out.

Referring again to FIG. 2, as indicated previously, it is preferred that the cabinet 12 and the ironing board 18 each be fabricated from a unitary piece of material each of which was fabricated from a single sheet of material. With the embodiment taking the preferred shape represented in FIGS. 1–4, the first step in fabricating the embodiment is to select a suitable piece of material and cut the outer perimeter 16 of the cabinet 12 to the proper shape and size. The next preferred step is to bore two holes through the outer perimeter 16 of the cabinet 12 and into the exterior perimeter 20 of the ironing board 18. The two bores will receive the pivots 26 at a later step. The size of the bores should be selected to ensure a proper fit of the pivots 26 once they are installed.

The next step is to form the channeled slot 32 in accordance with the previously provided explanation. Since the ironing board 18 has not yet been separated from the cabinet 12, the alignment of the channeled slot 32 is ensured. The channeled slot 32 can be formed using techniques well known in the industry, such as routing. Those skilled in the art will appreciate that automated milling equipment can readily carry out the steps described herein.

With the channeled slot 32 being formed, the ironing board 18 is next separated from the piece of material. The ironing board 18 can be cut to any appropriate shape. The gap 40 between the interior perimeter 14 of the cabinet 12 and the exterior perimeter 20 of the ironing board 18 is preferably ¼ inch but can be any suitable dimension. With the ironing board 18 separated from the piece of material, the stop 34 can be inserted into the channeled slot 32.

It will be appreciated that by forming the bores which will receive pivots 26 and the channeled slot 32 before the separation of the ironing board 18 from the frame 12 ensures that these structures are properly aligned. Proper alignment of these structures is important to the proper operation and appearance of the apparatus 10.

Still referring to FIG. 2, after the stop 34 has been properly inserted into the channeled slot 32, the pivots 26 are inserted into the bores previously prepared. With the pivots 26 properly inserted, the principal assembly steps are complete and in many instances the apparatus can be packaged for shipment. It will be appreciated that the illustrated apparatus can be readily packaged and shipped because of its simple shape and slim line profile. Finishing work may be carried out on the apparatus before packaging. Furthermore, in some instances it may be desirable to include a locking mechanism (not illustrated in the figures) to hold the ironing board in its storage position.

In view of the forgoing, it will be appreciated that the present invention provides an ironing board which can be readily mounted on, or incorporated into, many different vertical surfaces, which can be fabricated very efficiently and economically, and has a thin profile which protrudes above the underlying mounting surface only a small distance. The present invention also provides an ironing board which can be mounted on any number of different vertical surfaces without requiring intrusion into, or modifications to, the underlying surface and which can be fabricated from inexpensive materials. The apparatus of the present invention also requires few parts, little assembly, and is rugged and sturdy. Moreover, fabrication of the apparatus in accordance with the present invention ensures proper alignment of important structures and provides proper operation and appearance of the apparatus.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States letters patent is:

1. An ironing board comprising:

a single and unitary piece of substantially planar material having a thickness;

a frame formed from the piece of substantially planar material;

an opening formed in the frame, the opening having an interior perimeter shape;

an ironing board, the ironing board formed from the single and unitary piece of substantially planar material comprising the frame, the ironing board having a thickness which is substantially the same as the thickness of the frame and the ironing board having a perimeter shape which is substantially the same as the interior perimeter shape of the opening;

means for pivotally moving the ironing board within the opening in the frame between a first position wherein the ironing board is substantially coplanar with the frame and a second position wherein the ironing board is oriented at an angle to the frame and the ironing board protrudes out from a plane formed by the frame; and means for limiting the pivoting movement of the ironing board at the second position which is not more than substantially perpendicular to the frame, the frame being mountable on a surface and the ironing board moved into its first position when storage of the ironing board is desired and moved into its second position when use of the ironing board is desired.

2. An ironing board as defined in claim 1 wherein the frame and the ironing board are both less than about two inches thick.

3. An ironing board as defined in claim 1 wherein the means for limiting the pivoting movement comprises:

a first slot formed in the ironing board;

a second slot formed in the frame, the first slot and the second slot being arranged colinearly; and a stop having a first end and a second end, the first end being held at least slidably captive within the first slot and the second end being held at least slidably captive within the second slot, a length of the first slot, the second slot, and a length of the stop being selected so that the pivoting movement of the ironing board is limited to a range of about ninety degrees.

4. An ironing board as defined in claim 1 wherein the means for limiting the pivoting movement of the ironing board comprises:

first means for limiting the pivoting movement of the ironing board; and second means for limiting the pivoting movement of the ironing board.

5. An ironing board as defined in claim 1 wherein the frame is fabricated from a hardwood material and the ironing board is fabricated from a hardwood material.

6. An ironing board as defined in claim 1 wherein the means for pivotally moving the ironing board in the opening in the frame comprises:

a pair of bores, the opening including two parallel sides, each of the bores provided on one of the two parallel sides of the opening and the bores formed from an interior perimeter of the opening to an exterior perimeter of the frame;

a pair of bores provided on the ironing board, the ironing board including two parallel sides and each of the bores provided on one of the two parallel sides at a proximal end thereof; and a pivot structure inserted into each of the bores such that the ironing board is pivotally held within the opening.

7. An ironing board as defined in claim 1 wherein the interior perimeter of the opening comprises a six sided shape and the exterior perimeter of the ironing board comprises a substantially similar six sided shape.

8. An ironing board as defined in claim 1 further comprising means for mounting the frame on a substantially vertical surface.

9. A storable table requiring support only from a substantially vertical mounting surface, the table comprising:

a single and unitary piece of substantially planar material having a length, a width, and a thickness;

a frame formed from the single and unitary piece of substantially planar material;

an opening formed in the frame, the opening having an interior perimeter shape;

a planar work surface having a thickness not greater than the frame's thickness and of a size and shape such that the work surface films within the opening in the frame, the planar work surface formed from within the length and the width of the single and unitary piece of substantially planar material from which the frame is formed, the planar work surface having a thickness which is substantially the same as the thickness of the frame and the planar work surface having a perimeter shape which is substantially the same as the interior perimeter shape of the opening;

means for pivoting the planar work surface between a first position wherein the planar work surface is substantially coplanar with the frame and a second position wherein the planar work surface extends out from a plane formed by the frame and the vertical mounting surface; and means for limiting the pivoting movement of the planar work surface to a range which is not substantially greater than ninety degrees, the frame being mountable on the vertical mounting surface and the planar work surface moved into its first position when storage of the planar work surface is desired and moved and held in its second position when use of the planar work surface is desired.

10. A storable table as defined in claim 9 wherein the meats for limiting the pivoting movement comprises:

a first allot formed in the planar work surface;

a second slot formed in the frame, the first slot and the second slot being arranged colinearly; and a stop having a first end and a second end, the first end of the stop being held at least slidably captive within the first slot and the second end of the stop being held at least slidably captive within the second slot, a length of the first slot, the second slot, and a length of the stop being selected so that the pivoting movement of the ironing board is limited to a range of not substantially more than about 110 degrees.

11. A storable table as defined in claim 9 wherein an interior perimeter shape of the opening and an exterior perimeter shape of the work surface are substantially the same and wherein the frame is fabricated from hardwood material and the work surface is fabricated from the same hardwood material.

12. A storable ironing board which is mountable on a substantially vertical mounting surface, the storable ironing board comprising:

a single and unitary piece of substantially planar material having a length, a width, and a thickness;

a cabinet frame formed from the single and unitary piece of substantially planar material, the cabinet frame having a Length, width, and a thickness which are substantially the same as the length, width, and the thickness, respectively, being not greater than about three inches;

an opening formed in the cabinet frame, the opening having an interior perimeter shape;

an ironing board, the ironing board formed from within the length and width of the single and unitary substantially planar material from which the cabinet frame is formed, the ironing board having a thickness which is substantially the same as the thickness of the frame and the ironing board having a perimeter shape which is substantially the same as the interior perimeter shape of the opening and which fits within the opening, the ironing board having a work surface;

means for pivotally moving the ironing board, the means for pivotally moving being positioned at a proximal end of the ironing board and at one end of the opening in the cabinet frame such that the ironing board moves between a first position wherein the ironing board is substantially coplanar within the cabinet frame and a second position wherein the ironing board is oriented at an angle to the cabinet frame;

a first slot formed in the ironing board;

a second slot formed in the cabinet frame, the first slot and the second slot being arranged colinearly;

a stop having a first end and a second end, the first end being held at least slidably captive within the first slot and the second end being held captive slidably within the second slot, a length of the stop being less than the combined lengths of the first and second slots, the length of the stop, first slot, and second slot being selected so that the pivoting movement of the ironing board is limited to a range of not more than about 110 degrees such that the cabinet frame is mountable on a surface and the ironing board moved into its first position when storage of the ironing board is desired and moved into its second position when use of the ironing board is desired.

13. A storable ironing board as defined in claim 12 wherein the cabinet frame and the ironing board are both fabricated from the same sheet of material, the sheet of material comprising a wood material.

14. A method of manufacturing an ironing board structure which is mountable on a substantially vertical surface so that the ironing board is movable between a storage position and a service position, the method comprising the steps of:

selecting a substantially planar member having a length and a width at least slightly greater than a length and a width of a completed ironing board;

forming at least one bore into the edge of the planar member such that the bore extends into an area of the planar member from which the ironing board will be formed;

forming a slot on one surface of the planar member such that the slot is oriented substantially perpendicularly to the at least one bore and such that the slot is formed partially in the area of the planar member from which the ironing board will be formed;

forming a cut along the perimeter shape of the ironing board after the bore and the slot have been formed, said cut being at least a minimum distance from the exterior perimeter of the planar member, the cut allowing the ironing board to be removed from the planar member and leaving an opening in the planar member;

pivotally attaching a proximal end of the ironing board near one end of the opening formed in the planar member using the previously formed bore so that the ironing board will be properly aligned and such that the ironing board is pivotable between the storage position where the ironing board is substantially coplanar with the planar member and the service position where the ironing board is substantially perpendicular to the planar member; and forming means for supporting the ironing board in the service position using the previously formed slot which is now divided into two segments which are accurately aligned, the means for supporting the ironing board limiting the pivoting movement of the ironing board to a range of less than about 110 degrees between the storage position and the service position and such that the means for supporting is substantially contained within a thickness of the planar member when the ironing board is in its storage position.

15. A method of manufacturing an ironing board as defined in claim 14 further comprising the step of attaching the planar member to a substantially vertical surface.

16. A method of manufacturing an ironing board as defined in claim 14 wherein the planar member has a thickness of not more than about two inches.

17. A method of manufacturing an ironing board as defined in claim 14 wherein the step of forming a slot comprises the step of forming a grooved slot and the step of forming means for supporting the ironing board comprises the step of inserting a stop into the grooved slot.

18. A method of manufacturing an ironing board as defined in claim 14 wherein the step of forming a first cut comprises the step of making a complete enclosed cut in the planar member in the shape of an ironing board.

19. A method of manufacturing an storable work surface structure which is mountable on a substantially vertical surface so that the ironing board is movable between a storage position and a service position, the method comprising the steps of:

selecting a substantially planar member having a length and a width at least slightly greater than a length and a width of a completed work surface upon which objects are placable;

forming at least one bore into the edge of the planar member such that the bore extends into the area of the planar member from which the work surface member will be formed;

forming a slot on one surface of the planar member such that the slot is oriented substantially perpendicularly to the at least one bore and such that the slot is formed partially in an area of the planar member from which the work surface member will be formed;

forming a complete cut in the planar member in the shape of the work surface member, said complete cut being at least a first distance from an exterior perimeter of the substantially planar member, the complete cut allowing the work surface member to be removed from the planar member and leaving an opening in the planar member;

pivotally attaching a proximal end of the work surface member near an end of the opening formed in the planar member using the previously formed at least one bore and such that the work surface member is pivotable between the storage position where the work surface member is substantially coplanar with the planar member and the service position where the work surface member is substantially perpendicular to the planar member; and forming means for supporting the work surface member in the service position using the previously formed slot and such that the work surface member pivots only in a range of less than about 110 degrees between the storage position and the service position and such that the means for supporting is substantially contained within the thickness of the planar member when the work surface member is in its storage position.

* * * * *